United States Patent [19]

Zeller et al.

[11] Patent Number: 4,538,983

[45] Date of Patent: Sep. 3, 1985

[54] FOLDABLE SAFETY LIGHTER

[75] Inventors: Noel E. Zeller, 7 Brentwood Ave., White Plains, N.Y. 10605; Bronislaw Zapolski, Princeton, N.J.

[73] Assignee: Noel E. Zeller, Mount Vernon, N.Y.

[21] Appl. No.: 540,785

[22] Filed: Oct. 11, 1983

[51] Int. Cl.[3] ..... F23Q 7/12

[52] U.S. Cl. ..... 431/255; 361/260; 219/383; 431/264

[58] Field of Search ..... 219/260, 261, 262, 268, 219/267, 383, 384; 431/143, 255, 264, 265, 266, 131; 361/260, 261; 123/146.5 C

[56] References Cited

U.S. PATENT DOCUMENTS 3,200,295 5/1965 Owens ..... 431/255 X
3,280,881 10/1966 Hatch, Jr. et al. ..... 431/255
3,408,153 10/1968 Ishijuro ..... 431/143
4,292,021 9/1981 Miyagawa ..... 431/13

*Primary Examiner*—Volodymyr Y. Mayewsky
*Attorney, Agent, or Firm*—Jordan B. Bierman

[57] ABSTRACT

The invention comprises a safety lighter for providing a flame for lighting camp fires, cooking stoves, heaters, lanterns, and the like. The safety lighter has a housing for a fuel container and an electric igniting device, and an extension tube, mounted to the forward end of the housing, that is pivotable from a folded position to an extended position, wherein a flame can be provided at its end remote from the user's hand. The housing has a recess in which a push-button is positioned for actuating the providing of fuel and the igniting device simultaneously. When the extension tube is folded, it lies parallel to the housing over the recess and the push-button so that the lighter cannot be accidentally ignited.

11 Claims, 6 Drawing Figures

FOLDABLE SAFETY LIGHTER

TECHNICAL FIELD

The invention relates to a foldable safety lighter for lighting camp fires, cooking stoves, heaters, lanterns and the like.

BACKGROUND ART

The common match has a number of problems as a tool for lighting a fire, principally that it requires both hands to strike a flame, that it is difficult to maintain a flame under windy conditions, and that the flame cannot readily be provided remote from the user's hand. Conventional fuel-supplied lighters can maintain a constant flame because of the continuous supply of combustible fuel to the flame point. However, lighters also have the problem that the flame provided is generally proximate to the hand of the user, and create an unsafe condition particularly when they are used to light material that is highly combustible.

Accordingly, it is a principal object of the invention to provide a fuel-supplied lighter that can provide a flame remote from the user's hand, yet is compact and has safety features which prevent its becoming lit at times not intended by the user. It is another object of the invention to provide a safety lighter that can be operated by the user with one hand and in one motion to provide both a continuous charge of lighter fuel and an electrically ignited spark for the fuel. It is a further object to provide a safety lighter that can be folded and unfolded from a compact safe storage configuration to one where a flame is provided at a point remote from the user's hand.

DISCLOSURE OF THE INVENTION

In accordance with the above and further objects of the invention, a safety lighter comprises a compact housing that fits in the user's hand and holds a fuel container and means for igniting the fuel, the housing having a recess formed on one side thereof, means for actuating the igniting means positioned in the recess, and an extension tube, having one end for providing a flame, pivotable from a first position wherein the tube extends parallel to the housing over the recess so as to block access to the actuating member, and a second position wherein the tube extends away from the housing to allow access to the actuating member and to provide a flame at the end remote from the housing.

The invention further provides for simultaneously actuating the igniting means and a valve for the fuel supply. In particular, the actuating means includes a push-button positioned in the recess and connected to a plunger having a shoulder portion and a smaller-diameter stem portion. A pivotable cam is provided for actuating a piezoelectric crystal through a movable contact engaging the shoulder portion of the plunger, and the fuel supply valve is actuated by contact between the stem portion and a rocking lever controlling the valve. A principal safety feature of the device is provided in that the tube is pivotable to a position extending parallel to the housing and blocking access to the push-button in the recess, whereby the device can be stored in a compact configuration and in a safety condition preventing unintentional actuation of the push-button.

BRIEF DESCRIPTION OF THE DRAWINGS

The above and further features and advantages of the invention are described in detail below in conjunction with the drawings, in which.

DETAILED DESCRIPTION OF THE INVENTION

Figure 1:
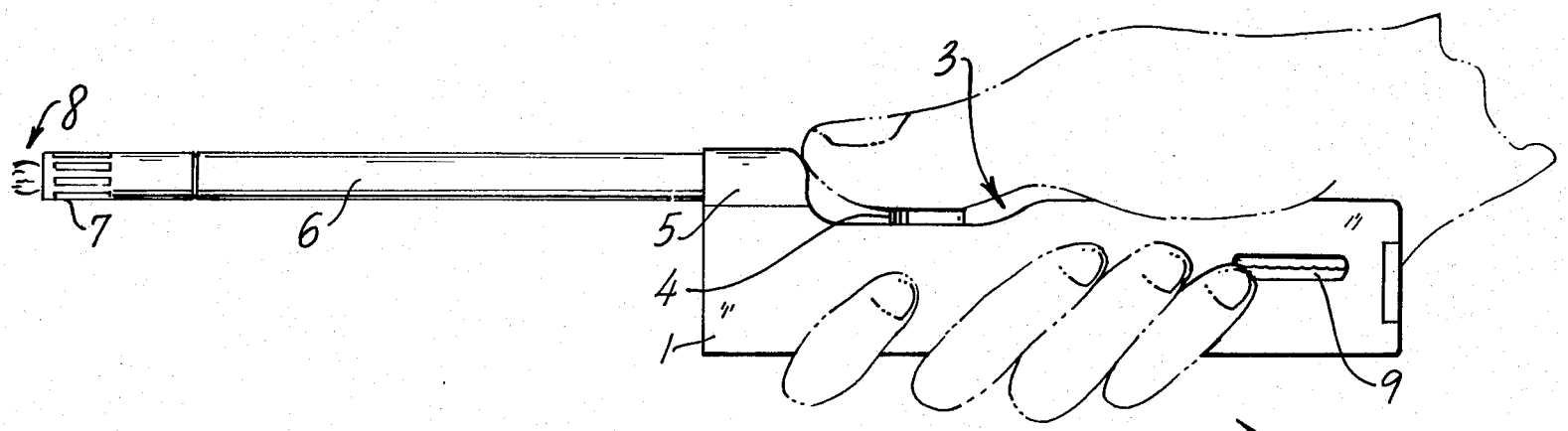
FIG. 1 is a side view of the safety lighter of the invention with its tube extended to the flame-lighting position.

The following is a description of a preferred embodiment of the invention, as illustrated in the drawings, and is not intended to limit the scope of the invention.

Referring to FIG. 1, a safety lighter in accordance with the invention has longitudinally extending housing 1 in a compact form that fits in the user's hand, generally indicated by reference numeral 2. The housing has a recess, indicated at 3, within which push-button 4 is positioned for operating the device. The recess is configured to comfortably accommodate the user's thumb for pressing the push-button to operate the lighter. Turret 5, is mounted at an operative forward end of the housing for securely holding long extension tube 6. The tube has end 7 adapted to issue a flame therefrom, generally indicated by reference numeral 8. Window 9 is provided at the rear end of the housing to allow the user to visually check the amount of fuel remaining in the housing.

Figure 2:
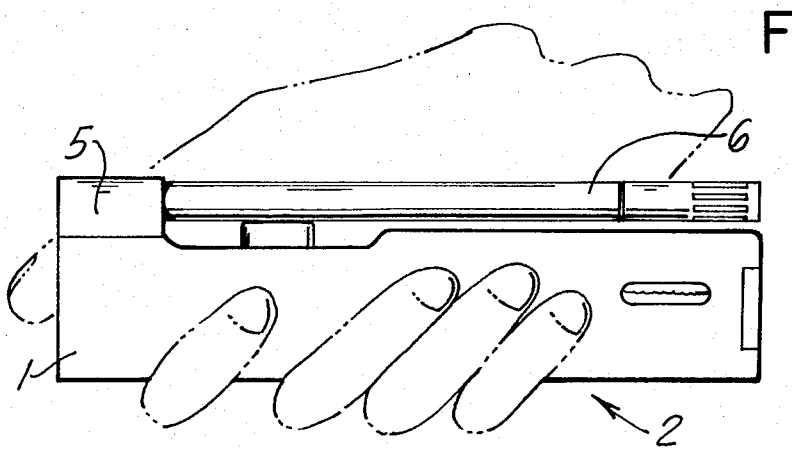
FIG. 2 is a further side view of the safety lighter with its tube folded to the safety storage position.

As shown in FIG. 2, the turret and extension tube are pivotable to a position in which the tube extends parallel and adjacent to the housing. In this position, called the storage position, tube 6 extends over recess 3 and blocks access to push-button 4 to prevent accidental ignition of the lighter. The folded lighter is also compact and less vulnerable to breakage under rough conditions, such as when packed for camping trips.

Figure 3:
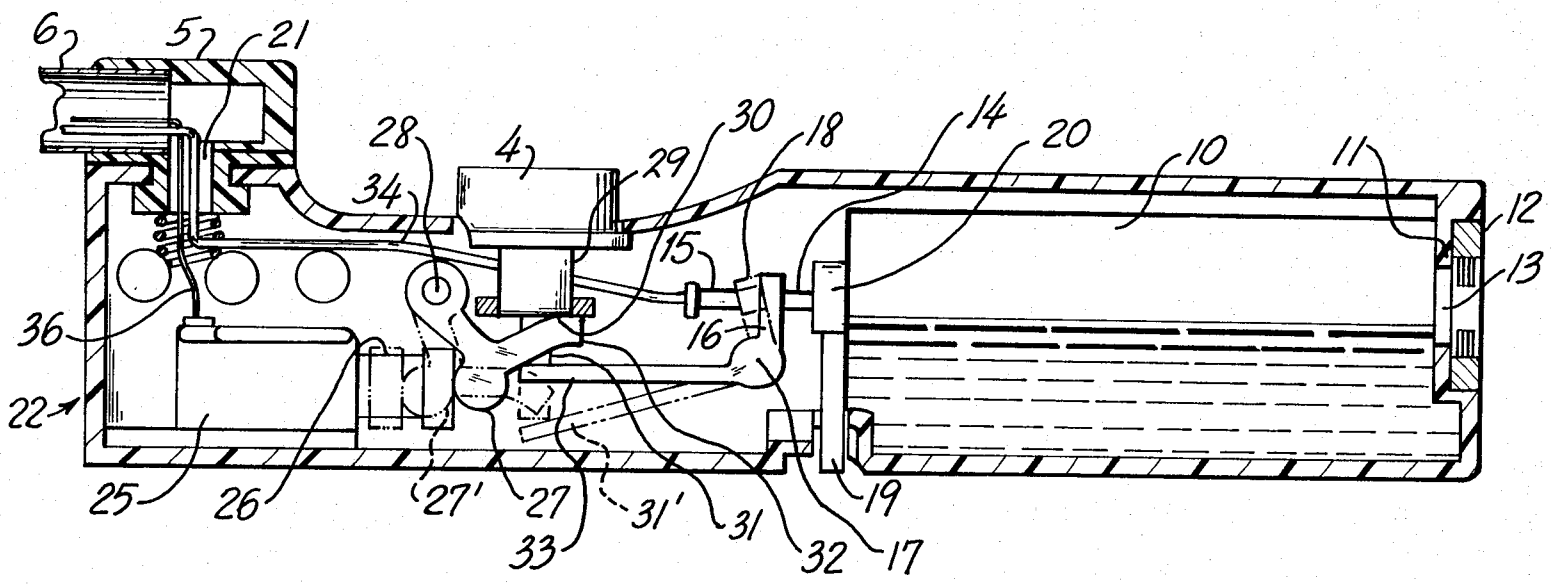
FIG. 3 is a schematic cross-sectional side view of the safety lighter of FIG. 1.

The interior of housing 1 is shown schematically in FIG. 3. Fuel container 10 is located at the rear end of the housing abutting rear wall 11. Hinged hanger 12 is usable to hang the unit on a wall, and opening 13 allows access to container 10 for re-filling when the fuel supply therein is low. The fuel supply can be visually checked through window 9 in the housing wall. Nozzle 14 extends from the fuel container and has movable valve 15 arranged thereon. Rocking lever 16 is mounted for pivotal movement about pivot point 17 to move valve 15 to the open position 18 when the device is operated to provide a flame. Lever 19 extends from a recess in the underside of the housing to rotate metering valve 20 controlling the supply of fuel in nozzle 14. The fuel is preferably a pressurized liquid fuel such as butane which, upon opening of valve 15, exits from container 10 through nozzle 14 as a vapor under pressure.

Nozzle 14 is connected to hose 34 which is threaded to the forward end of the housing generally indicated at 22, through an aperture 21 in rotatable turret 5 and into extension tube 6 to end 7. Piezoelectric crystal 25 is mounted in the forward end 22 of the housing and has movable contact 26 in engagement with an end of cam 27 mounted for pivotal movement about pivot point 28. When cam 27 is pivoted to the position shown at 27', the piezoelectric crystal generates an electric charge which is carried by wire 36 through turret 5 to end 7 of tube 6.

The push-button for the safety lighter is arranged to actuate both piezoelectric crystal 25 and movable valve 15 for the fuel supply simultaneously. This permits the user to light a flame with one hand by the single motion of depressing the push-button. Push-button 4 is connected to plunger 29 having shoulder portion 30 and stem portion 31. Plunger 29 is normally biased upward by a spring (not shown in the drawing). Shoulder 30 is arranged in contact with lever 32 of cam 27. When push-button 4 is depressed, the downwardly moving shoulder 30 pivots cam 27 to the position shown at 27', in which the cam displaces contact 26 of piezoelectric crystal 25 to provide an electric charge through wire 36. At the same time, stem portion 31, extends through a slot in lever 32 and is in contact with end 33 of lever 16. When push-button 4 is depressed, stem portion 31 pivots lever end 33 to the position shown at 31'. In this position, lever 16 moves valve 15 to the position shown at 18 wherein fuel is supplied from fuel container 10 into hose 34.

Figure 4:
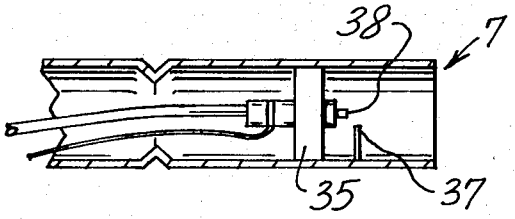
FIG. 4 is a cross-sectional side view of the flame-providing end of the extension tube of the safety lighter.

Referring to FIG. 4, the flame-providing end 7 of tube 6 has plug 35 for sealing the end and preventing fuel vapor from going back into tube 6. Hose 34 is connected to metal nozzle 38 mounted in plug 35. Wire 36 from piezoelectric crystal 25 is in contact with nozzle 38. The piezoelectric crystal 25 is grounded to a common ground with extension tube 6. A pin 37 extending from the tube wall at end 7 provides a spark point proximate the exit from nozzle 38. When push-button 4 is depressed, an electric charge is provided to nozzle 38 and sparks across the gap to pin 37, at the same time that fuel vapor is supplied through nozzle 38. A flame is thus ignited and remains lit as long as the user continues to depress push-button 4. Release of the button closes valve 15 and safety terminates the flame. The flame can be re-lit only by depressing the push-button again.

Figure 5:
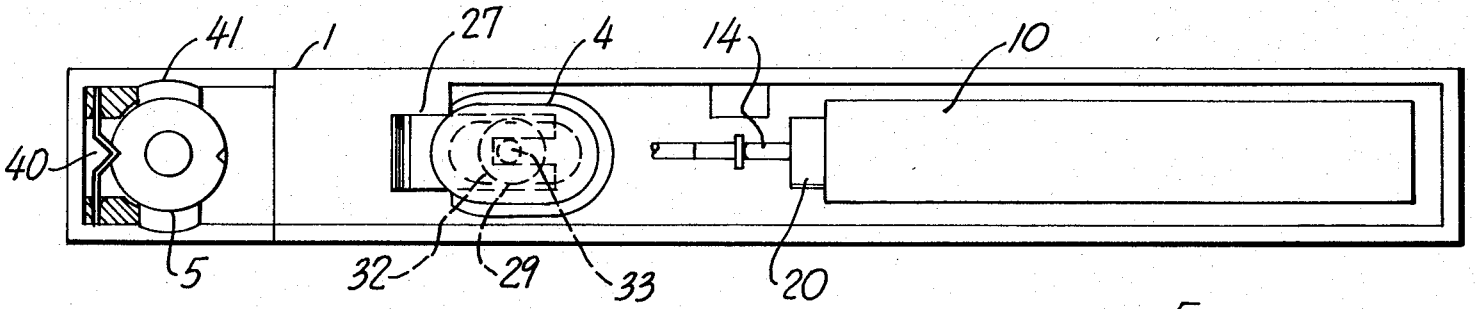
FIG. 5 is a top cross sectional view of the safety lighter.
Figure 6:
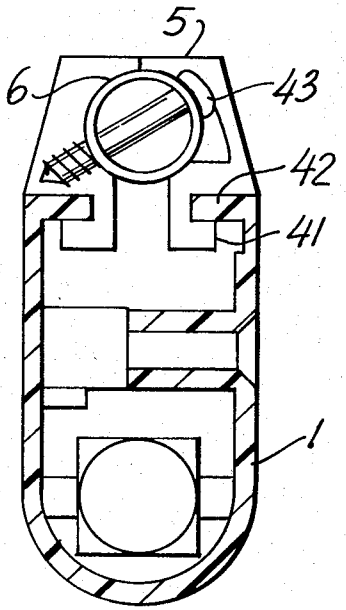
FIG. 6 is a front cross sectional view taken of the forward end of the safety lighter.

The pivotal movement of tube 6 is provided by turret 5 mounted at the forward end of the housing. Turret 5 is movable from the storage position shown in FIG. 2 to the extended position shown in FIG. 1 and is located in said positions by a detent member 40, shown more clearly in FIG. 5. The turret 5, in FIG. 6, has a flange 41 in pivotal arrangement with collar 42 extending from the housing wall. Threaded screw 43 secures tube 6 to turret 5.

The invention thus provides a foldable safety lighter that can issue a constant flame remote from the user's hand and is operable merely by the press of a push-button. When it is not in use, it conveniently folds in half and prevents unintentional lighting by the tube blocking access to the push-button.

Although this invention is described with reference to the above-specified material, steps, and elements, it should be understood that a variety of modifications may be made without departing from the principles of the invention. All such modifications are intended to be included within the spirit and scope of the invention, which is defined in the following claims.

We claim:

1. In a safety lighter of the type having a housing which contains a fuel container, fuel providing means for providing fuel from the fuel container to a flame point, igniting means including an insulated conductor for providing a spark at the flame point to ignite fuel provided from the fuel container to the flame point, and actuating means for actuating said fuel providing means and said igniting means, the improvement comprising said housing having a recess formed on one side thereof; said actuating means being positioned in said recess; and an extension tube having one end for supporting said flame point and its other end mounted on a forward pivotal member of said housing for pivotal movement of said tube between a first position wherein said tube extends parallel to said housing over said recess so as to block access to said actuating means, and a second position wherein said tube extends away from said housing for allowing access to said actuating means and for providing a spark for a flame at said one end remote from said housing.

2. The safety lighter of claim 1, wherein said fuel providing means is located in said housing at a supply end of said fuel container adjacent said igniting means, said actuating means actuating simultaneously both said igniting means and said fuel providing means.

3. The safety lighter of claim 1, wherein said actuating means comprises a push-button positioned in said recess for operating the lighter, a plunger connected to said push-button and extending into said housing, a first pivotable member for actuating said igniting means arranged in contact with said plunger, and a second pivotable member in contact with said plunger for actuating said fuel providing means.

4. The safety lighter of claim 3, wherein said plunger has a shoulder portion in contact with said first pivotable member, and a stem portion extending beyond said shoulder in contact with said second pivotable member.

5. The safety lighter of claim 2, wherein said fuel providing means includes a movable valve controlling the supply of fuel from said fuel container.

6. The safety lighter of claim 2, wherein said fuel providing means further includes a second valve controlling the rate of the supply of fuel from said fuel container, and a lever for adjusting said second valve extending from said housing.

7. The safety lighter of claim 1, wherein said igniting means comprises a piezoelectric element wherein said housing and an insulated electrical conductor for providing a voltage generated by the piezoelectric element as a spark at the flame point.

8. The safety lighter of claim 1, wherein said forward pivotable member of said housing is a turret for mounting said tube for pivotal movement between said first and second positions.

9. The safety lighter of claim 8, wherein said turret comprises detent means for positively locating said turret in said first and second positions.

10. A safety actuating device for a safety lighter of the type having a fuel container, means for providing fuel from the fuel container to a flame point, and igniting means including an insulated conductor for providing a spark to ignite the fuel provided at the flame point, comprising an actuating member for operation of the safety lighter, a plunger movable by said actuating member in a downward movement against a biasing force, said plunger having a shoulder portion and a stem portion extending downwardly beyond said shoulder portion, a first pivotable member for actuating one of said igniting and fuel providing means having one end in contact with the shoulder portion of said plunger and its other end arranged for operation of said one of said means upon the downward movement of said plunger, and a second pivotable member for operating the other of said means having one end in contact with said stem portion of said plunger and its other end arranged for operation of said other means upon the downward movement of said plunger.

11. The safety actuating device of claim 10, wherein said shoulder portion and said stem portion are concentric about a longitudinal axis of said plunger, said stem portion being of smaller diameter than said shoulder portion, and said one end of said first pivotable member having a pair of arms spaced apart a distance greater than the diameter of said stem portion but less than the diameter of said shoulder portion, said pair of arms being arranged in contact with said shoulder portion and having said stem portion extending through the space therebetween.

* * * * *